US006814094B1

(12) United States Patent
Barber

(10) Patent No.: US 6,814,094 B1
(45) Date of Patent: Nov. 9, 2004

(54) CANOPY FABRIC TENSIONING APPARATUS

(75) Inventor: James Norman Barber, Ocala, FL (US)

(73) Assignee: Shade Systems, Inc., Pompano Beach, FL (US)

( * ) Notice: Subject to any disclaimer, the term of this patent is extended or adjusted under 35 U.S.C. 154(b) by 0 days.

(21) Appl. No.: 10/434,860

(22) Filed: May 9, 2003

(51) Int. Cl.[7] ..... E04H 15/64
(52) U.S. Cl. ..... 135/119; 135/123
(58) Field of Search ..... 135/119, 907, 135/123, 122, 88.1, 88.01; 160/378, 328; 248/273

(56) References Cited

U.S. PATENT DOCUMENTS 5,573,028 A 11/1996 van der Stigohel
6,213,138 B1 * 4/2001 Wimpee ..... 135/121
6,250,322 B1 6/2001 Porter
6,505,638 B1 * 1/2003 Powell et al. ..... 135/124
6,651,685 B2 * 11/2003 Connelly et al. ..... 135/117

* cited by examiner

*Primary Examiner*—Ramon O. Ramirez
*Assistant Examiner*—Ingrid Weinhold
(74) *Attorney, Agent, or Firm*—Alvin S. Blum

(57) ABSTRACT

A rigid metal frame supports a fabric cover to provide a fabric-covered canopy. The frame has a series of the elongate rafters with free ends. Cables in the hem on the margin of the cover are used to apply tension to the cover to pull it taut and secure it to the frame. A tensioning apparatus on at least some of the free ends of the rafters hooks onto the cables and pulls them taut. A sleeve slidably mounted on the free end of the rafter carries the hook. A threaded rod accessible from the free end of the rafter is operatively connected to the sleeve so that rotation of the rod in a first direction applies tension to the cables and rotation in the opposite direction releases the tension. This enables the cover to be applied and removed easily. Vandal-resistant features prevent ready access to rotating the rod.

9 Claims, 2 Drawing Sheets

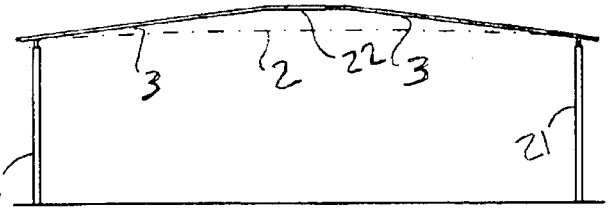
FIG. 2
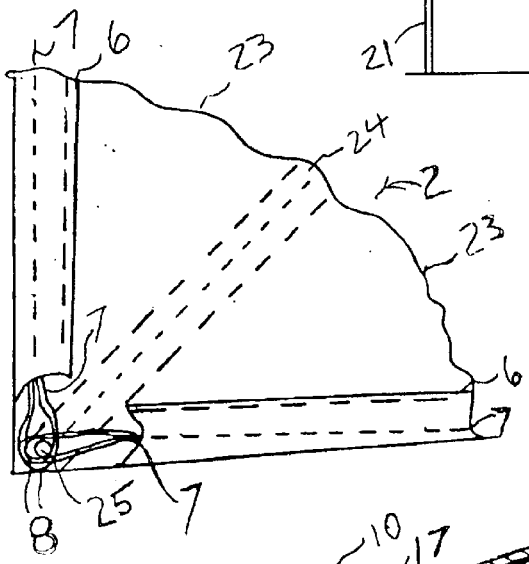
FIG.4
FIG. 3
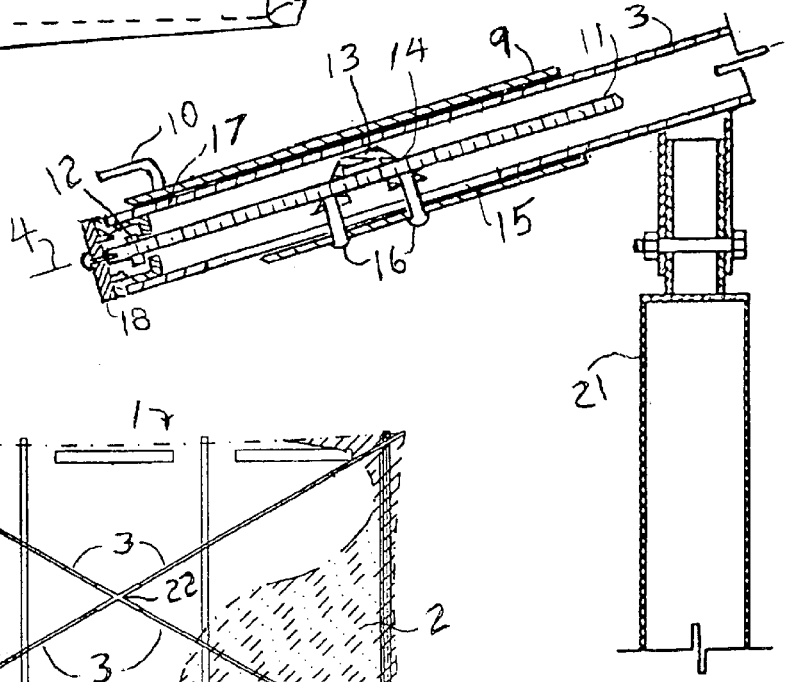
FIG. 1
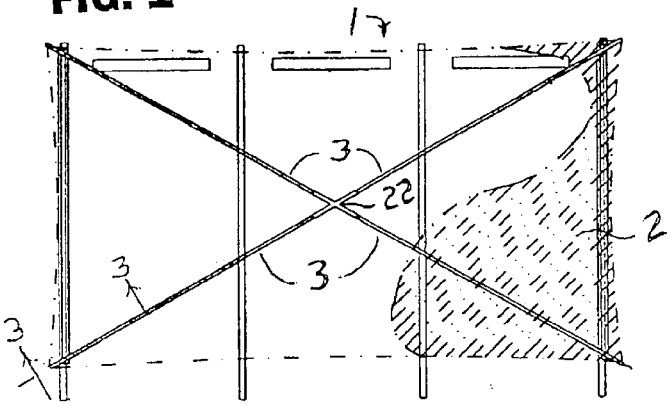

FIG. 6
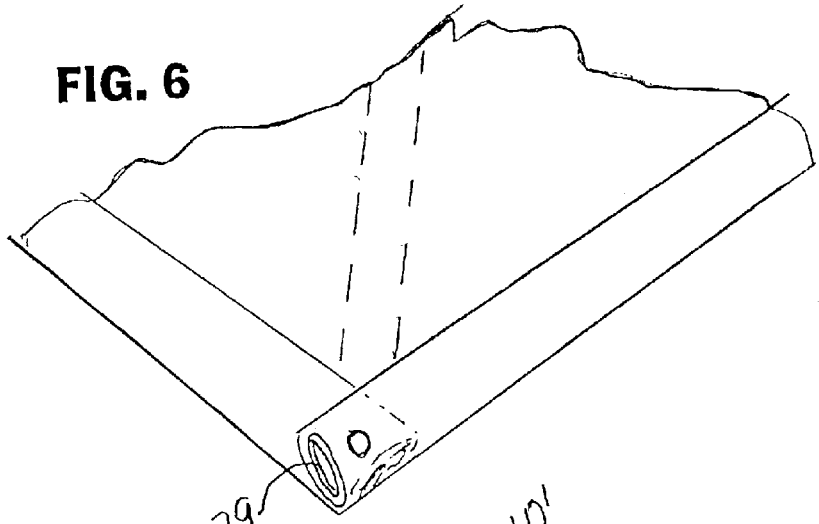
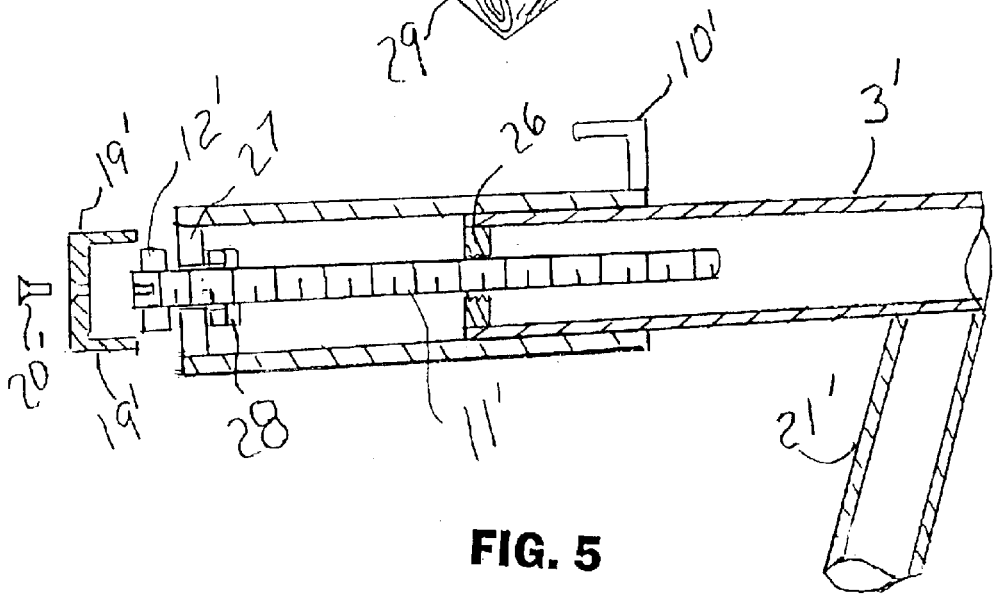
FIG. 5

CANOPY FABRIC TENSIONING APPARATUS

This invention relates generally to building structures, and more particularly relates to the fastening system for a fabric covering to a metal frame to form an inexpensive shading structure for use over places such as playgrounds, sports fields, parking lots, and the like.

BACKGROUND OF THE INVENTION

For human health, as well as human comfort, it is desirable to provide a sunshade above many outdoor gathering and recreation areas. Such areas include playgrounds, sports fields, parking lots, swimming pool decks, and other outdoor commercial areas. The presence of a sunshade in such areas allows people to gather on bright, sunny days without the fear of sunburn caused by the sun's harmful ultraviolet rays. Such sunshades also significantly lower the air temperature in vehicles parked below, and can be used as an inexpensive alternative to garage buildings. Sunshades for vehicles can be used by residences, car dealerships, car washes, and office building parking lots.

There are a variety of sunshade products which address the need to provide shade for the above applications. However, those currently on the market do not include a simple, self-contained mechanism which allows for fast and easy removal and re-installation of the fabric canopy. They generally have a cable in the perimeter hem of the fabric cover. They feature a fixed hook at each roof beam corner, and a tensioning cable which must be pulled through the hem at the perimeter of the fabric canopy around the entire structure. Where the ends of the cable finally meet, the installer must use a "come-along" or other heavy tool to forcibly tension the cable. However, merely applying strong force and tensioning the cable does not ensure an even and taut fit over the frame. The process involved in adjusting and re-tensioning the cable to secure the fabric canopy evenly and tautly over the frame can be a lengthy exercise of trial-and-error maneuvers. In order to apply tension to the cable, a special apparatus is applied to the cable to pull it taut. The cable is then fixed on the hooks in that position, and is not easily released to remove the cover. Such quick removal and re-installation would be required when storms or high winds threaten. Many potential purchasers of sun shades do not consider their purchase due to the excessive time it would take to remove the fabric canopy in the case of a storm, high winds, or hurricane.

SUMMARY OF THE INVENTION

It is accordingly an object of the invention to provide a mechanism which allows for the quick and easy installation, removal, and re-installation of the fabric canopy over a metal structural frame. It is another object that the operating mechanism be self-contained within the completed structure with the exception of a wrench and screwdriver. The mechanism consists of a pipe sleeve with welded hook which slides over the structural rafter pipe of the canopy frame, and which travels along the long axis of the rafter when a concealed bolt head is turned using a hex wrench. A cable in the perimeter hem secures the fabric cover. The cable is engaged by the hook on the sleeve. Turning the bolt head counter-clockwise causes the sleeve and hook to travel back toward the peak of the canopy roof frame, thereby loosening the cable securing the fabric. Turning the bolt head clockwise causes the sleeve and hook to travel toward the outward corner of the canopy roof frame, thereby tightening the cable securing the fabric. This pulls the cover taut on the frame, and secures the cover in place. In this manner, simply turning the bolt head allows the fabric to be installed or removed quickly and easily, without the use of additional tools or manpower. Optionally, the hook may engage the fabric of the cover as well as the cable. Tensioning of the fabric cover is essential to provide smooth cover surfaces free of sags.

Ease of Installation

Products featuring the subject invention have an adjustable hook at each corner of the frame. The cables used for attachment to such adjustable hooks are factory-assembled inside the fabric hems, and ready to be slipped over the adjustable hooks. A separate cable segment with a loop at each end may be provided between tensioning members. Once the loops are attached to the hooks, the vandal-resistant bolt concealed in each roof frame beam is turned using the special wrench provided, thereby moving the adjust hooks outward toward the frame corners and tensioning the cables. Each side can therefore be tensioned evenly, resulting in a taut fabric canopy each time on the first try.

Ease of Removal

In the case of a storm with high winds, heavy snowfall, or other severe inclement weather for which the covers are not designed, it is recommended that the user remove the fabric canopy. The subject invention significantly reduces the time necessary to remove and re-install the fabric canopy, eliminates the need to cut the tensioning cable, and requires no additional tools other than the special vandal-resistant wrench provided. Customers who would otherwise be reluctant to purchase a canopy due to the excessive time required to disassemble it in case of severe are, therefore, likely to enjoy the advantages of a canopy.

Vandal-resistance

A further benefit of the subject invention is its vandal-resistant feature. The product may be installed in public or semi-public outdoor settings, making the it vulnerable to vandals. Prior art products feature fabric canopies which are tensioned and fastened using tumbuckles or other common fastening device. These are readily accessible and easy to vandalize. The instant invention conceals the fastening device inside the roof beam, and furthermore uses a vandal-resistant bolt to tension and de-tension the cable which secures the fabric canopy. Therefore, without the special wrench supplied, a vandal is unlikely to be able to de-tension the fabric canopy even after accessing the vandal-resistant bolt by removing the cast aluminum cap over the roof beam end.

BRIEF DESCRIPTION OF THE DRAWINGS

FIG. 1 is a plan view of a canopy of the invention over a three position parking space with the cover partially cut away.

FIG. 2 is a front elevation view of the canopy of FIG. 1.

FIG. 3 is a sectional view taken through line 3—3 of FIG. 2.

FIG. 4 is a plan view of a corner of the cover.

FIG. 5 is a sectional view as in FIG. 3 of another embodiment of the invention.

FIG. 6 is a plan view as in FIG. 4 of another embodiment of the cover.

DETAILED DESCRIPTION OF PREFERRED EMBODIMENTS

Referring now to the drawing FIGS. 1-4, a frame structure 1 has a fabric cover 2 that is shown partially cut away. The frame may be made of galvanized steel tubes, for example. A series of vertical posts 21 embedded in concrete support elongate inclined rafters 3 joined by a central connector 22. For a short span, the posts may be at the corners only. For a long span, there may be addition posts between the corners. The cover 2 may be made of a sturdy non-stretching, ventilated fabric that is resistant to ultraviolet light. As best seen in FIG. 4, the cover 2 may be made up of panels 23 sewn together at seams 24 that will run along the rafters. At the margins of the cover, hems 6 are formed. Individual segments of galvanized steel cable 7 with a loop 8 at each end are threaded through the hems with the loops emerging at a rafter coinciding with a hole 25 in the cover. A hook 10, as best seen in FIG. 3, passes through the two loops and the hole 25. When this hook is forced away from the center of the cover, in applies tension to the cord system, in this case the cables, and the cover. This holds the cover securely in place on the frame, and eliminates any sagging between supports.

As best seen in FIG. 3, the hook 10 is affixed to a sleeve 9 that is slidably mounted on the free end 17 of the rafter 3. A threaded rod 11 with a tool-engaging head 12 is rotatably mounted by mounting member 18 within the end 17. An element 13 within the rafter has a threaded passage 14 therethrough that is threadedly engaged by the threaded rod 11. Bolts 16 connect the sleeve 9 to the element. The bolts 16 pass through longitudinal slot 15 cut in the underside of the rafter to prevent filling with rainwater. When the bolt head is rotated the element 13 moves along the long axis 4 of the rafter. When rotated in a first direction, the element 13, a sleeve, and hook 10 are moved away from the center of the cover, thereby applying tension to the cover attached to the hook. When rotated in the opposite direction, the tension is released, and the cover can be removed. The system can be rendered more vandal-resistant by making the head so that it can only be engaged by a special wrench. The head 12 may be a special nut that is fixed onto the rod.

Referring now to FIG. 5, another embodiment of the tensioning mechanism is shown that does not require a slot in the rafter 3' supported by post 21'. A threaded plug 26 is affixed to the free end of the rafter. A hook 10' is affixed to sleeve 9' that slides along the rafter. A threaded rod 11' is rotatably held captive on endplate 27 affixed to the end of the sleeve by head 12' and lock ring 28 affixed to the rod. When the head is rotated in a first direction, tension is applied to the cover and cables attached to the hook. Rotation in the opposite direction releases the tension for cover removal. In addition, a cover 19' may be provided with a fastener 20' that equires a special screwdriver.

Referring now to FIG. 6, an embodiment of the invention is shown in which the cord system for applying tension to the cover comprises providing a margin 29 made up of multiple layers of the fabric. With a sturdy fabric having sufficient tensile strength, the use of a wire cable may be eliminated. Although it is less vandal-resistant, there are situations where this may not be a problem.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. In a fabric covered rigid frame structure having at least three a elongate rafters supporting the fabric cover, the rafters having a long axis, and a cord system encircling a perimeter of the fabric, a tensioning apparatus comprising:

A) a sleeve slidably mounted on a free end of at least three of the rafters for sliding motion along the long axis;

B) a hook affixed to the sleeve constructed for engaging the cord system;

C) means operatively interconnecting the sleeve and the rafter for forcing the hook and the cord system connected thereto along the long axis to apply tension to the cover in a first direction and to release tension in a second direction.

2. The apparatus according to claim 1 in which the means operatively interconnecting the sleeve and the rafter includes a screw thread that is rotatable in a clockwise and a counterclockwise direction for changing the tension on the cover.

3. The apparatus according to claim 2 in which the screw thread is on a rod with a free end having a tool engaging head for rotation, and further comprising a cover for the head that is protected by a vandal-resistant fastener.

4. The apparatus according to claim 1 in which the cord system comprises metal cables in a hem of the fabric cover.

5. The apparatus according to claim 1 in which the cord system comprises multiple layers of fabric in the perimeter of the fabric cover.

6. In a fabric covered rigid frame structure having at least three a elongate rafters supporting the fabric cover, the rafters having a long axis, and a cord system encircling a perimeter of the fabric, a tensioning apparatus comprising:

A) a sleeve slidably mounted on a free end of at least three of the rafters for sliding motion along the long axis;

B) a hook affixed to the sleeve constructed for engaging the cord system;

C) a threaded rod having a free end provided with a tool engaging head, rotatably mounted within the rafter with the tool engaging head accessible at the free end of the rafter;

D) an element within the rafter having a threaded passage therethrough threadedly engaging the rod so as to move along the rafter axis toward and away from the free end of the rafter by rotation of the tool engaging head;

E) means interconnecting the sleeve and the element for forcing the sleeve and the hook and the cord system connected thereto along the long axis to apply tension to the cover in a first direction of rotation of the head and to release tension in a second direction of rotation of the head.

7. The apparatus according to claim 6 in which the cord system comprises metal cables in a hem of the fabric cover.

8. The apparatus according to claim 6 further comprising a cover for the tool engaging head that is protected by a vandal-resistant fastener.

9. The apparatus according to claim 6 in which the cord system comprises multiple layers of fabric in the perimeter of the fabric cover.

* * * * *